US005941393A

United States Patent [19]

Wilfong, Jr.

[11] Patent Number: 5,941,393

[45] Date of Patent: Aug. 24, 1999

[54] EASY OPENING PLASTIC BAG PACK OF THE STAR-SEAL TYPE

[75] Inventor: Harry B. Wilfong, Jr., Hartsville, S.C.

[73] Assignee: Sonoco Development, Inc., Hartsville, S.C.

[21] Appl. No.: 09/121,804

[22] Filed: Jul. 23, 1998

[51] Int. Cl.[6] ..... B65D 30/20; B65D 33/10

[52] U.S. Cl. ..... 206/554; 383/8; 383/120

[58] Field of Search ..... 206/554; 383/8, 383/37, 120

[56] References Cited

U.S. PATENT DOCUMENTS

| | | | |
|---|---|---|---|
| 2,195,098 | 12/1940 | Mckay, Jr. et al. | 383/120 |
| 3,285,406 | 11/1966 | Winesett . | |
| 3,349,991 | 10/1967 | Kessler | 383/120 |
| 4,349,123 | 9/1982 | Yang . | |
| 4,406,371 | 9/1983 | Membrino . | |
| 4,557,384 | 12/1985 | Membrino . | |
| 4,759,639 | 7/1988 | DeMatteis . | |
| 4,759,742 | 7/1988 | Achelpohl . | |
| 4,769,125 | 9/1988 | Roen et al. . | |
| 4,769,126 | 9/1988 | Roen et al. . | |
| 4,785,938 | 11/1988 | Benoit, Jr. et al. | 206/554 |
| 4,790,437 | 12/1988 | Pistner | 206/554 |
| 4,854,451 | 8/1989 | Jensen . | |
| 5,192,133 | 3/1993 | Juel et al. . | |
| 5,207,328 | 5/1993 | Bose et al. . | |
| 5,209,573 | 5/1993 | Freeman | 383/120 |
| 5,248,040 | 9/1993 | DeMatteis et al. . | |
| 5,307,935 | 5/1994 | Kemanjian . | |
| 5,346,310 | 9/1994 | Nguyen . | |
| 5,467,572 | 11/1995 | Wile et al. . | |
| 5,469,969 | 11/1995 | Huang . | |
| 5,497,884 | 3/1996 | DeMatteis et al. . | |
| 5,561,967 | 10/1996 | Nguyen . | |
| 5,590,784 | 1/1997 | Daniels . | |
| 5,662,225 | 9/1997 | DeMatteis . | |
| 5,690,228 | 11/1997 | DeMatteis . | |
| 5,695,064 | 12/1997 | Huang et al. . | |

*Primary Examiner*—Stephen P. Garbe
*Attorney, Agent, or Firm*—Alston & Bird LLP

[57] ABSTRACT

A pack of easy opening handleless or T-shirt type plastic bags for packaging grocery produce or the like and for being suspended from a rack for being serially opened and removed from the rack. Each type of bag includes integrally formed front and rear walls and gusseted side walls which extend inwardly towards each other and which terminate proximate each other. The walls have top portions defining an open mouth. Each T-shirt type bag includes laterally-spaced handles extending upwardly from the mouth portion on each side of the bag. The front and rear walls and gusseted side walls of each bag are folded onto each other along a longitudinal axis of the bag to define eight superimposed layers. A seal of the star seal type secures the bottoms of the eight layers together to close each bag bottom. Superimposed detachable tabs extend upwardly from the eight wall layers at the top of each bag. Each tab includes an aperture for mounting on a tab-retaining device of a rack. At least the front two tabs in each handleless bag and the front four tabs in each T-shirt type bag are front-side-free for easy opening. One form of mounting tabs for either type of bag provides tabs which are detachable from the bags and remain with the rack as the bags are removed. Another form of mounting tabs for either type of bag provides tabs which are detachable from the rack and remain with the bags as they are removed.

18 Claims, 5 Drawing Sheets

EASY OPENING PLASTIC BAG PACK OF THE STAR-SEAL TYPE

FIELD OF THE INVENTION

This invention relates to a pack of easy opening plastic bags of the "star seal" type particularly suited for use in packaging grocery produce and adapted for being suspended in desired lengths from a rack for being serially opened and removed from the rack.

BACKGROUND OF THE INVENTION

Plastic bags have been replacing paper bags in the United States since the 1970s (and elsewhere more recently) in the grocery and retail products industries due to the superior and inherent moisture resistant properties and strength of plastic. In these industries, these plastic bags have usually included integrally connected front and rear wall portions and, sometimes, gusseted side wall portions, all secured together at the bottoms thereof by a seal to define a closed bottom on the bag. The bag walls are open at the top to define a mouth portion on the bag. Some of these bags are of the "T-shirt" type which provides spaced integral handles laterally extending upwardly from opposed sides of the open mouth of the bag at the top to provide ease In carrying of the bag by the consumer. However, these plastic bags have also included handleless generally flat top rectangular shape bags, similar to the prior paper bags, without upwardly extending handles. These plastic bags have been provided to and used by the grocery and retail product industries in the form of packs of a plurality of superimposed bags connected together and adapted to be serially opened and removed from the rack, or in the form of a roll of plastic bags connected end-to-end and mounted on a rack to be serially removed and opened up, for packaging of the grocery or retail products. The produce bag market in the United States grocery industry has been dominated over the years by plastic bags on a roll. These bags are typically manufactured of LDPE or HMW-HDPE in gauges from 0.50 to 0.35 mil. The biggest complaint with this style bag by shoppers is the difficulty in getting the bag opened. Recently, grocery produce bags have been introduced of the HMW-HDPE construction which utilize a "star seal" to close the bottom of the bag. The "star seal" design (well known in the industry as a bag having multiple layers and longitudinally folded over on itself and sealed at the bottom so that when it is opened up, the bottom of the bag viewing from the inside resembles a star) got its start in the HMW-HDPE can liner market because of the excellent bottom seal strength it offers with thin gauge films.

Grocery produce bags of this star seal type have been accepted in part because of their strength, but also because they are somewhat easier to open than the traditional roll produce bags. Openability of this star seal type bag is improved due to the increased number of layers of film at the bag mouth. Notwithstanding, the shopper still mistakes the bottom of the bag from the top of the bag leading to frustration in opening of the bag. For the most part, these star seal type plastic produce bags have been provided in the roll form, although some bag packs of superimposed star seal type bags have been proposed. However, to applicant's knowledge, all of these bag packs of star seal type bags have been connected at the bottoms of the bags and suspended from a rack bottom-side-up so that the user must first remove the bag from the bag pack and then open the bag prior to loading of produce therein. This arrangement has presented additional problems with opening of the individual bags and does not provide for serially opening or self-opening of the bags as they are removed from the bag pack and from the rack.

OBJECT AND SUMMARY OF THE INVENTION

Accordingly, it is the object of this invention to provide a pack of easy opening plastic bags of the star seal type which are particularly suited for use in packaging grocery produce and which are adapted for being suspended in desired lengths from a rack for being serially opened and removed from the rack for easy packaging of produce and which overcomes the problems presented with prior plastic bags of this type.

It has been found by this invention that the above object may be accomplished by providing such a pack of easy opening plastic bags constructed generally, as follows. Front and rear walls and gusseted side walls are integrally formed with each other. The gusseted side walls extend inwardly toward each other to terminate in close proximity to each other. All of the walls define an open mouth at their tops. The front and rear walls and the gusseted side walls are further folded over onto themselves along a longitudinal axis of the bag to define eight superimposed wall layers in the bag. A seal of the star seal type secures the bottoms of the eight superimposed wall layers together to close the bottom of the bag. A detachable tab extends upwardly from the top portions of each of the eight wall layers at the open mouth and are in superimposed positions and include an aperture adapted for mounting each of the tabs on a tab retaining device of the rack so that the bags hang downwardly from the tab retaining device with the open mouth portion of the bags at the top. At least the front two tabs of the eight superimposed tabs have means rendering at least the front two wall layers of each bag front-side-free so that these wall layers open up and, thus, the mouth of the bag opens up as the bag is serially removed from the bag pack and from the rack.

In accordance with a first embodiment of this invention, a plastic bag is provided which includes the above structural features and which is of the handleless type and in which the tabs extend integrally upwardly from each of the eight wall layers at the top portions. In one form, these tabs are constructed for being detached from such wall layers and remain on the rack as the bags are serially removed from the pack and the rack. In another form, the tabs are constructed for being detached from the tab retaining device of the rack and remain with the bags as the bags are serially removed from the pack and from the rack.

In a second embodiment of the invention, a pack of easy opening plastic bags of the T-shirt type is provided which includes the above described general structural features and additionally includes handle layers extending upwardly from the top portions of each of the walls. These handle layers are in superimposed positions on each side of the open mouth to form two groups of four handle layers having seals securing the tops of each group of handle layers together to define laterally spaced upwardly-extending handles on each side of the bag in an opened position thereof. These handles are also folded, along with the front and rear walls and gusseted side walls, over onto each other to define eight superimposed handle layers and two superimposed handles in the folded bag which receives a star seal across the bottom of the eight wall layers to close the bottom of the bag. In this embodiment, the mounting tabs extend upwardly from the eight wall layers and at the tops of the handle layers and at least the front four tabs of the eight superimposed tabs have means for rendering one of the handles front-side-free for aiding in opening of the bags. One form of these tabs is detachable from the handle layers to remain on the rack after serially removing of each of the bags from the bag pack and the rack. Another form of these tabs is detachable from the rack to remain with the bag as each bag is serially removed from the pack and the rack.

The tabs of the first and second embodiment which are detachable from the bags to remain on the rack include means, preferably in the form of a partial cut across the tab or in the form of a line of perforations, to render the tabs detachable from the bags. Also, the tabs of each of the two embodiments which are detachable from the rack and which remain with the bag Include means, preferably in the form of a V-shaped cut-out and nick extending towards the tab mounting aperture or a line of perforations extending toward the tab mounting aperture, for allowing detachment of the tabs from the rack while providing sufficient strength to prevent premature detachment. Preferably, each of the tabs in both embodiments include at least one welded area securing the tabs together for maintaining the bags in the pack. Also, it is preferable to provide a frangible bond between each of the bags in the pack to aid in serially opening of the bags as the bags are serially removed from the pack.

BRIEF DESCRIPTION OF THE DRAWINGS

Some of the objects and advantages of this invention have been set forth above and other objects and advantages will appear in the detailed description of preferred embodiments of the invention to follow, when taken in conjunction with the accompanying drawings, in which:

FIG. 8 is a perspective view of a handleless bag of the type illustrated in FIG. 1 and removed from the rack and from the pack and being in open position and containing grocery produce or the like;

FIG. 17 is a perspective view of a T-shirt plastic bag constructed in accordance with FIG. 16 and having been removed from the rack and from the pack and opened up for receiving grocery produce or the like;

DETAILED DESCRIPTION OF PREFERRED EMBODIMENTS OF THE INVENTION

Figure 1:
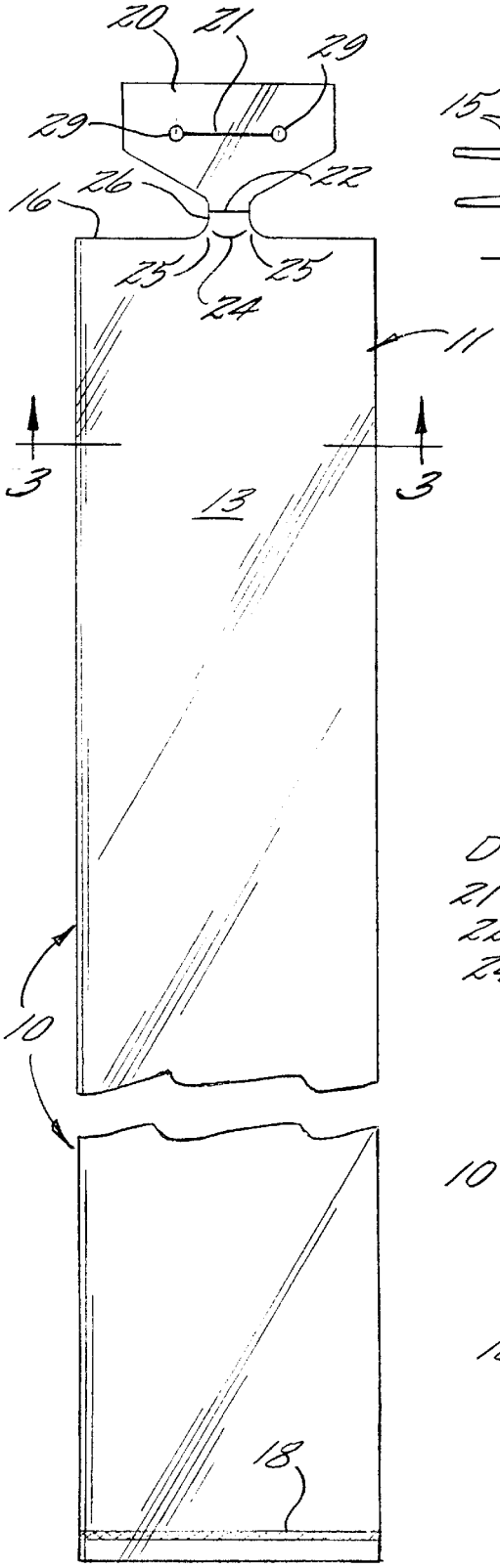
FIG. 1 is an elevational view, broken away of a first embodiment of a pack of easy opening plastic bags of the handleless type and constructed in accordance with this invention and having a first form of mounting tabs thereon.

In the following detailed description of this invention, various embodiments are described in order to provide a full and complete understanding of the invention and its preferred embodiments. It will be recognized that although specific terms are employed to describe specific structural elements, these terms are employed in the descriptive sense and these structural elements are susceptible to numerous and various alternatives, modifications and equivalents as will be apparent to the skilled artisan.

Referring now to the drawings, a first embodiment of the invention is illustrated in FIGS. 1–15 and a second embodiment of the invention is illustrated in FIGS. 16–19. The first embodiment of the Invention illustrated in FIGS. 1–15 includes a first form illustrated in FIGS. 1–8 and a second form illustrated in FIGS. 9–15. The second embodiment of the invention illustrated in FIGS. 16–19 includes a first form illustrated in FIGS. 16–17 and a second form illustrated in FIGS. 18–19. In all of these embodiments and forms of the invention, like reference numerals will be utilized in describing structural features which are common to both embodiments of the invention.

Figure 2:
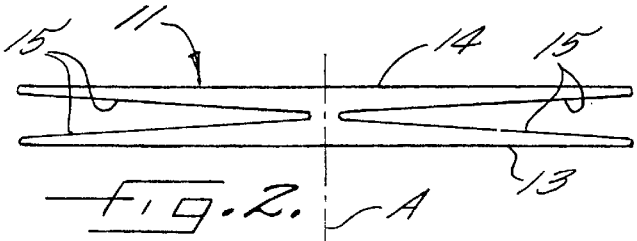
FIG. 2 is a sectional view through a bag of the bag pack of FIG. 1 prior to the front and rear wall and gusseted side walls being longitudinally folded over onto themselves so that the star seal may be applied to secure the bottom of the bag.
Figure 3:
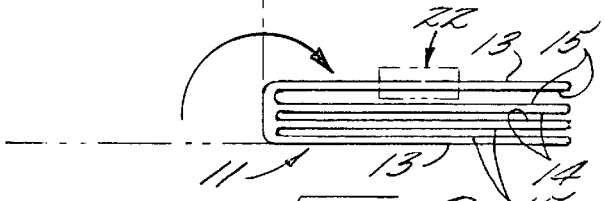
FIG. 3 is a schematic and diagrammatic sectional view, taken generally along the line 3—3 of FIG. 1, of one bag of the bag pack and showing the bag of FIG. 2 longitudinally folded over onto itself for sealing the bottom of the bag in the star seal and which further Illustrates the front-side-free cut through the front two layers of the bag.
Figure 4:
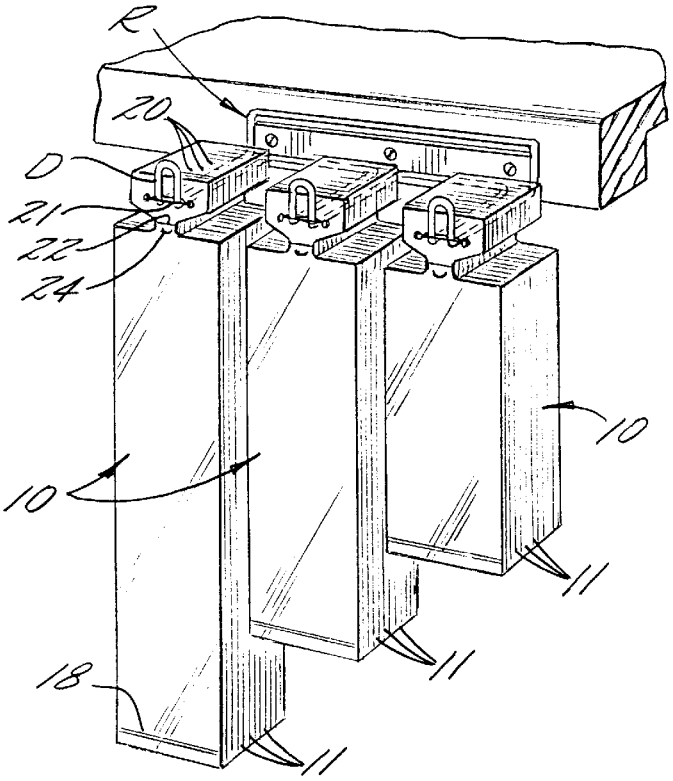
FIG. 4 is a perspective view of three bag packs of handleless bags of the type illustrated in FIG. 1 and of different lengths and mounted on tab retaining devices of a rack.
Figure 7:
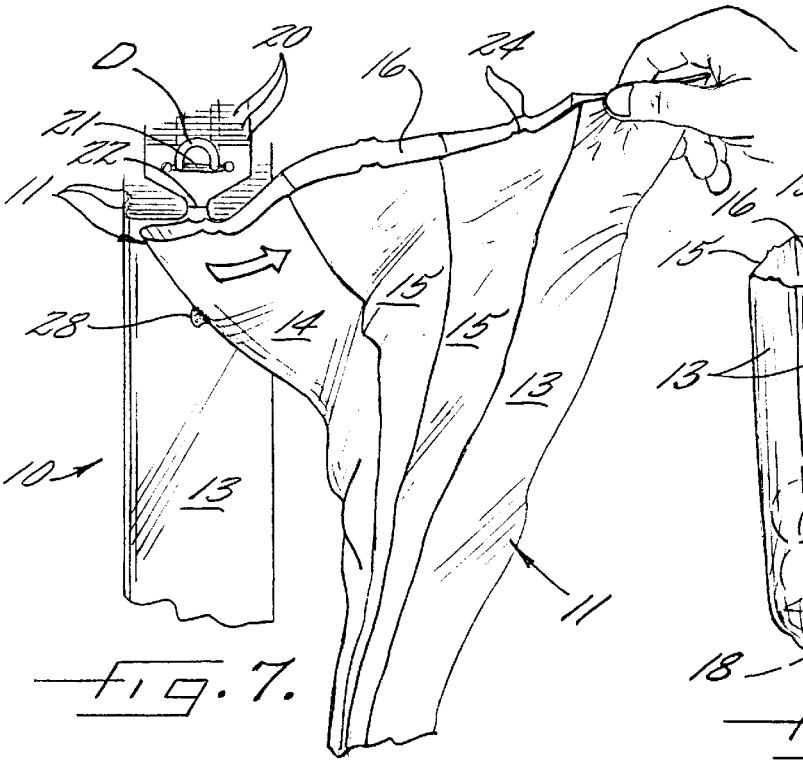
Figure 8:
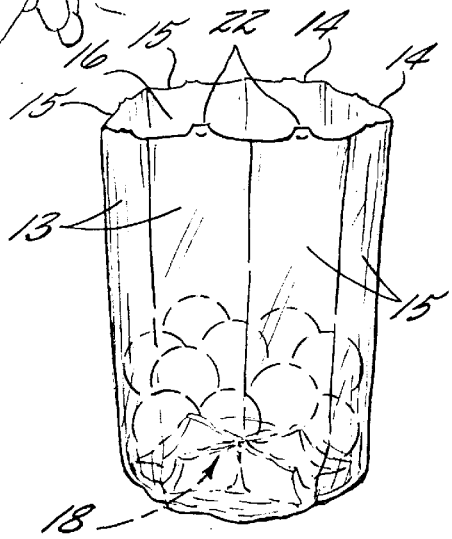
Figure 17:
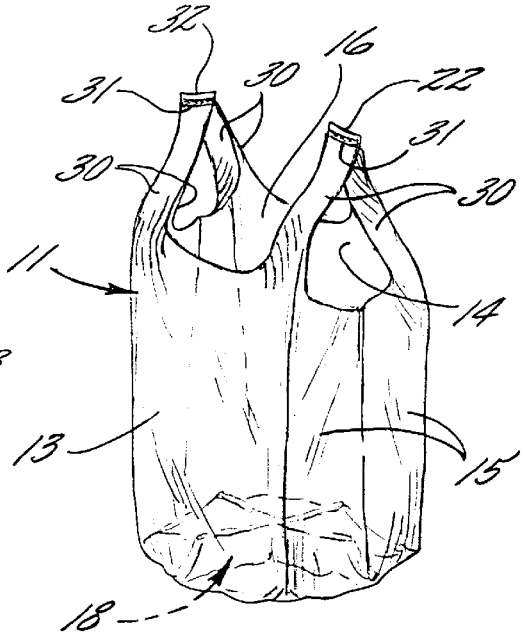

Both embodiments of the invention include a pack 10 of easy opening plastic bags 11 adapted for being suspended in different lengths from tab retaining devices D of a rack R (see FIG. 4) for being serially opened and removed from the rack (see FIGS. 5–7, 12 and 15) for packaging grocery produce or the like (see FIG. 8). Each of the bags 11 comprises (see particularly FIG. 2) integrally formed front and rear walls 13, 14 and gusseted side walls 15 which extend inwardly toward each other to terminate in close proximity to each other. All of the walls 13, 14 and 15 have top portions defining an open mouth 16 for the bag 11. The front and rear walls 13, 14 and the gusseted side walls 15 are further folded over onto each other along a longitudinal axis A of the bag 11 to define eight superimposed wall layers 13, 14 and 15 in the bag 11 (as shown in FIGS. 2 and 3). A seal 18 of the "star seal" type secures the bottoms of the eight superimposed wall layers 13, 14 and 15 together to close the bottom of the bag 11. As discussed above, a "star seal" is well known in the industry as a seal for securing the bottom of multiple layers of a bag so that when the bag is opened up and viewed from the inside thereof, the inside resembles a star (as shown in FIGS. 8 and 17).

Detachable tabs 20 extend upwardly from each of the eight wall layers 13, 14 and 15 at the top portions thereof and in the area of the open mouth 16 of the bag. These detachable tabs 20 are in superimposed position and each include an aperture 21 for mounting the tabs 20 on a tab retaining device D of the rack R. At least the front two tabs 20 extending upwardly from the front two layers 13, 15 of the eight superimposed tabs 20 have means 22 to render at least these front two wall layers 13, 15 of the bag 11 "front-side-free" for aiding in easy opening of the bag 11. "Front-side-free" is a term well understood to the artisans in plastic bag packs mounted on racks wherein it is desirable to have one or more of the front layers of each bag free from the detachable tabs for easy opening.

Preferably, each of the remaining detachable tabs 20 which are not front-side-free include means 24 for rendering these remaining tabs 20 detachable from the bag 11 to remain on the rack R after removal of the bag 11 from the pack 10 (as shown in FIGS. 1–8) or means 40 for rendering these remaining tabs 20 detachable from the tab retaining device D of the rack R to remain with the bag 11 when the bag 11 is removed from the pack 10 and the rack R (as shown in FIGS. 9–15).

Figure 18:
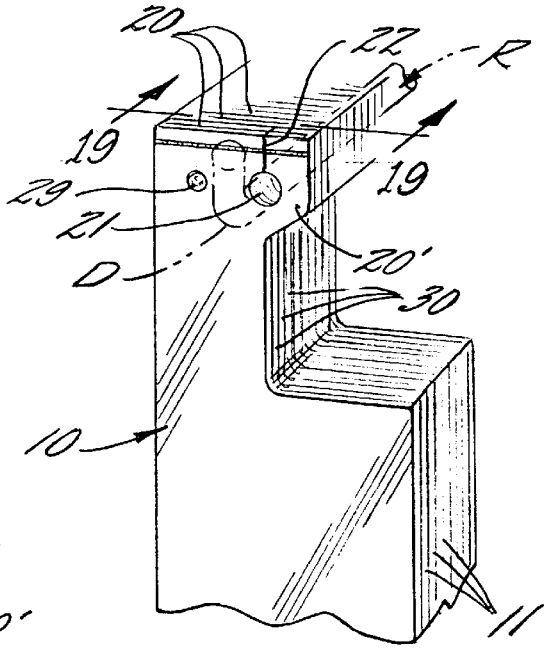
FIG. 18 is a partial perspective view of a pack of easy opening T-shirt plastic bags of the second embodiment and having an alternatively shaped tab at the top of the handle layers and having an alternatively shaped tab retaining aperture in the tabs and which is constructed in a second form to be detachable from the rack and remain with the bag as the bags are serially removed from the pack and from the rack.

The aperture 21 in the mounting tabs 20 may take various desired shapes depending upon the type of tab retaining device D utilized on the rack R. For example, if a tab retaining device D of the well known inverted U-shaped wire loop type, commonly referred to in the industry as a "D-ring" tab retaining device, is utilized, the tab mounting aperture 21 may be in the shape of a slit extending across the bag mounting tab 20 (as shown in FIGS. 1, 4–7 and 16) or the tab mounting aperture 21 may be of a generally spade shaped cut (as shown in FIGS. 9–12). When utilizing a tab retaining device D on the rack R of a generally single post hook shape (as illustrated in FIGS. 15 and 18), a circular tab mounting aperture 21 may be utilized (as illustrated in FIGS. 13–15 and 18–19).

In the first embodiment of bags 11 of a pack 10 (illustrated in FIGS. 1–15), the bags are of the handleless type in which the tabs 20 extend integrally upwardly from the top portions of each of the wall 13, 14 and 15. A first form of these tabs 20 is illustrated in FIGS. 1–8 and include means the 24 for rendering the remaining tabs 20, which are not front-side-free, detachable from the remaining bag wall layers to remain on the rack after removal of the bag 11 from the pack 10.

Figure 5:
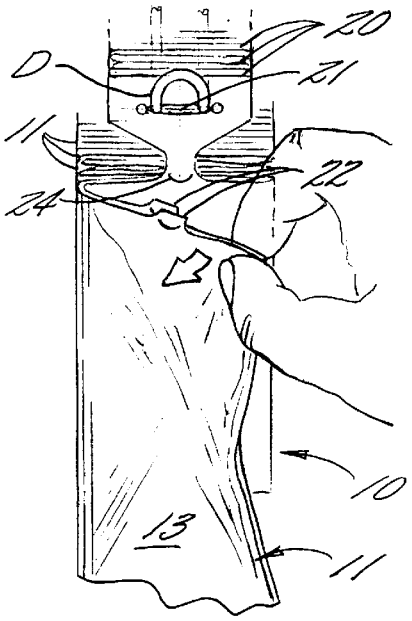
FIGS. 5, 6 and 7 are schematic perspective views of the handleless bag pack constructed in accordance with FIG. 1 and mounted on a rack and wherein the user is pulling the front two wall layers, which are front-side-free, away from the bag pack for opening of the bag and removal thereof from the rack and from the pack and showing progressive positions of the bag during such opening and removal from the rack and from the pack.
Figure 6:
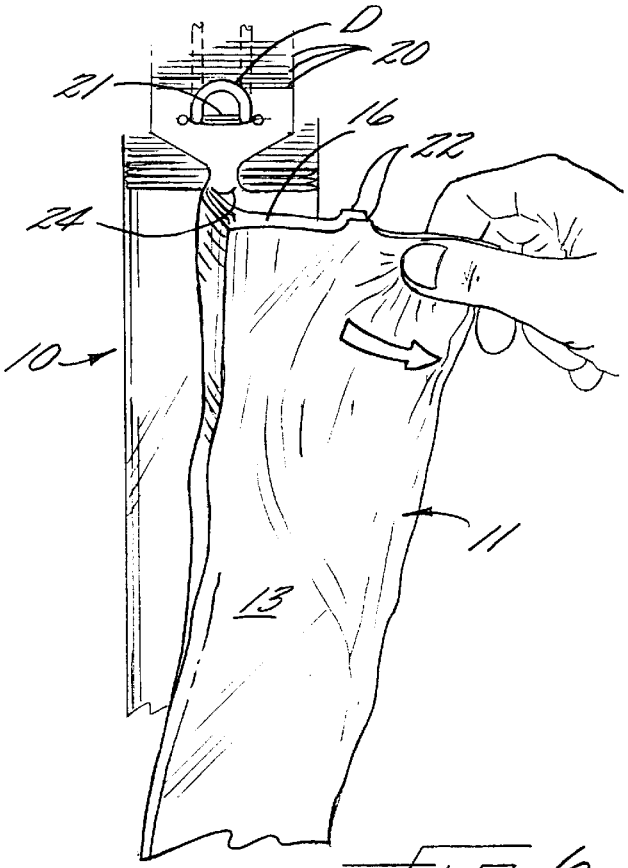

This means 24 may be in the form of a slit extending across a portion of the dimension of the tab 20 to define residual wall portions 25 (see FIG. 1) on either side of the slit 24 to adapt the tabs 20 to be easily torn to detach the tabs 20 from the bag 11 when serially removing the bags 11 from the pack 10 (as shown in FIGS. 5–7) so that the detached tabs 20 remain on the tab retaining device D of the rack R. The means 22 to render the front two wall layers 13, 15 of the bag 11 front-side-free may be in the form of a cut 22 extending across the entire dimension of these two tabs 20. It may be desirable from a processing or manufacturing standpoint to include a slit 24 in all of the detachable tabs 20 including those which have the front-side-free slit 22 therein since it would be easier to insert the slit 24 in all of the superimposed bags 11 in a pack 10 during the manufacturing operation. Accordingly, the slit 24 is shown in the top bag 11 of the pack 10 of FIG. 1 in addition to the front-side-free slit 22. Preferably, each of these first form of detachable tabs 20 of the first embodiment of handleless type bags 11 (as shown In FIGS. 1–8) include a neck portion 26 which is narrower than the remaining portion of the tab 20 (see FIG. 1 particularly) and which connects the tabs 20 to the respective bag wall layers 13, 14, 15. The slits 22, 24 are preferably located in the neck portion 26 to aid in detaching the bags 11 from the detachable tabs 20 (as shown in FIGS. 5–7).

Figure 9:
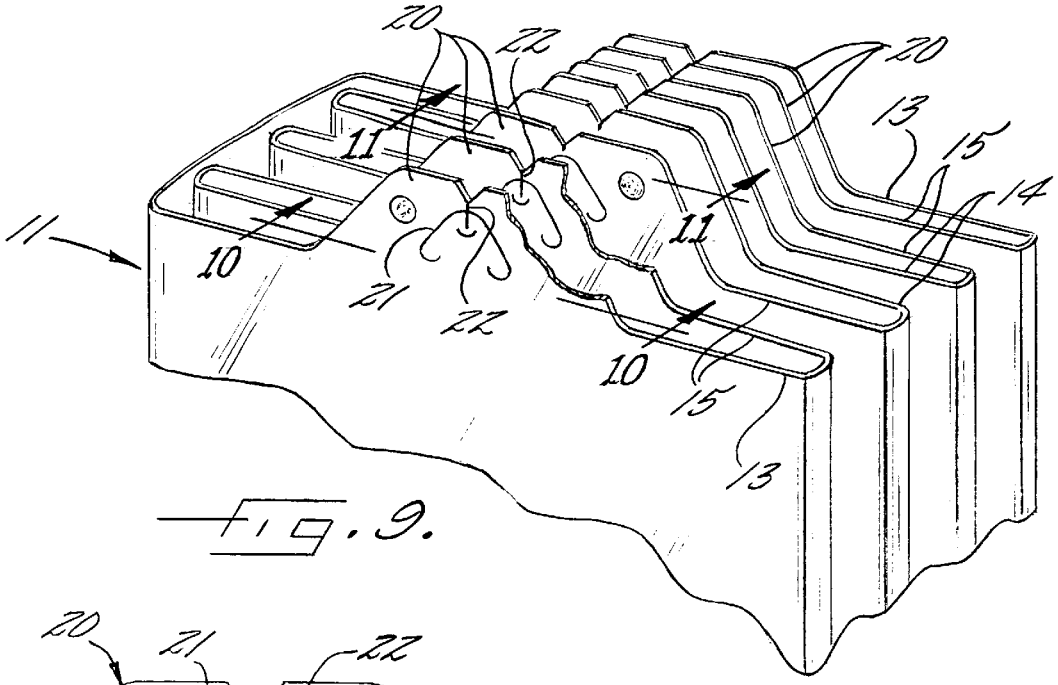
FIG. 9 is an enlarged partial perspective view of the top of a handleless type bag showing a second form of mounting tab at the top of each of the walls of the bag.
Figure 10:
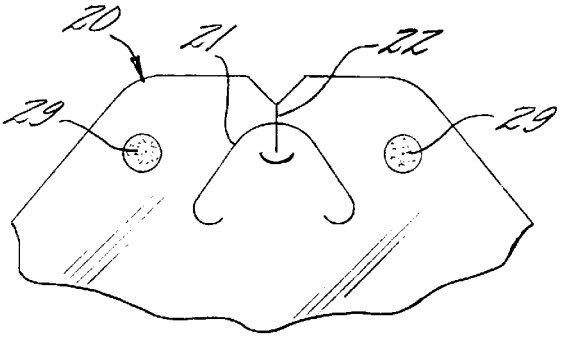
FIG. 10 is a further enlarged front elevational view of the second form of mounting tab which is constructed to be front-side-free and which is taken generally along the line 10—10 of FIG. 9.
Figure 11:
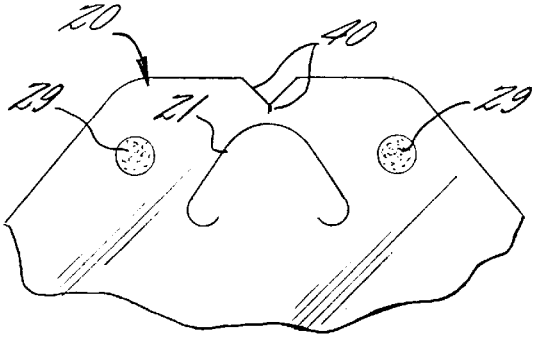
FIG. 11 is a view, like FIG. 10, of the second form of mounting tab of another layer of the bag which is not front-side-free, but which includes means for detaching the tab from the tab retaining device of the rack so that the tab remains with the bag when the bag is serially removed from the pack and from the rack.
Figure 12:
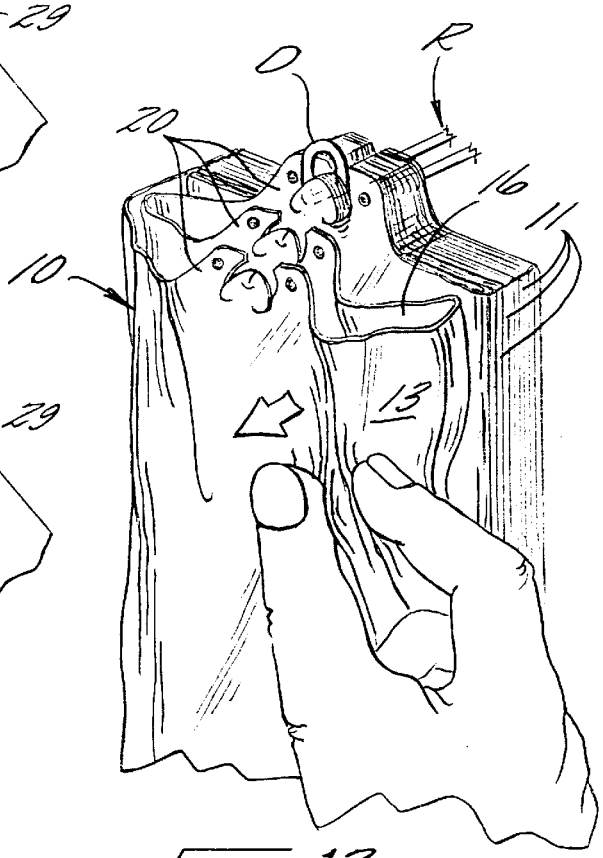
FIG. 12 is a schematic perspective view of the handleless type bag having the second form of tabs of FIGS. 9–11 and mounted on a rack and wherein the user is pulling the front two wall layers having the front-side-free tabs thereon from the rack for opening up the bag as the bag is serially removed from the pack and from the rack.
Figure 13:
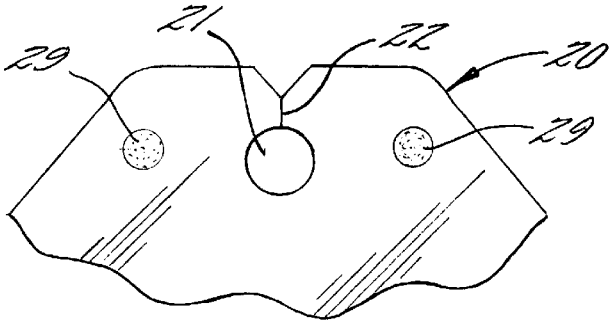
FIGS. 13, 14 and 15 are views, like FIGS. 10, 11 and 12, which illustrate an alternative shape to the aperture in the tabs mounted on the tab retaining device of the rack.
Figure 14:
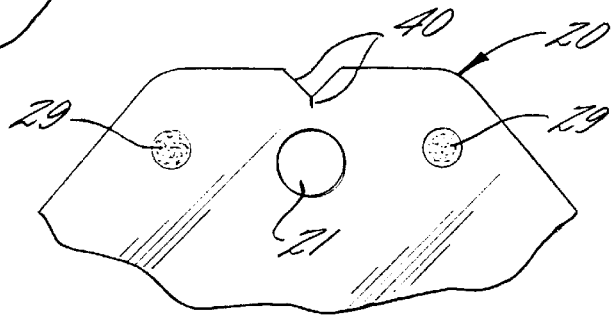
Figure 15:
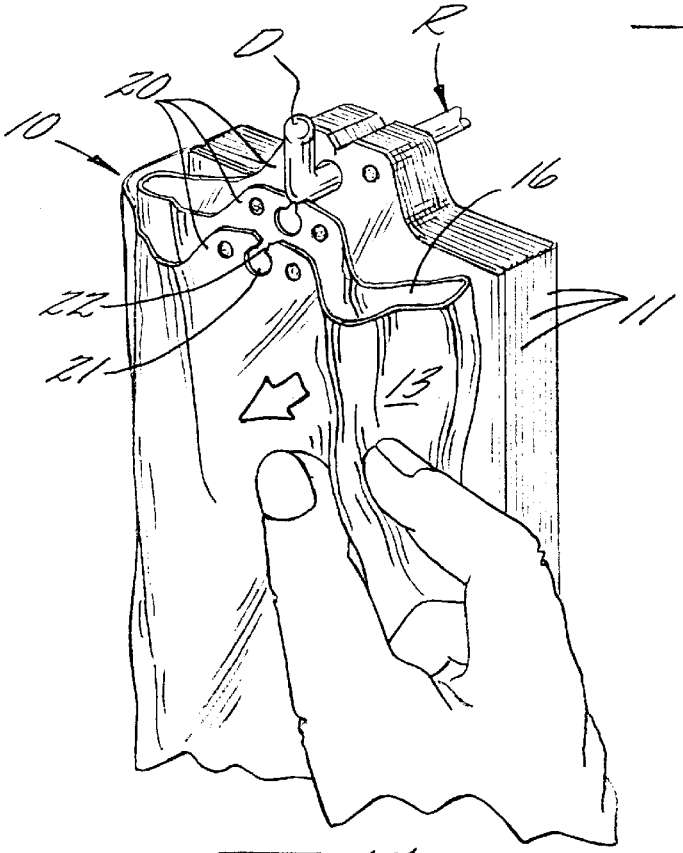

Referring to FIGS. 9–15, a second form of tabs 20 on a handleless type bag 11 is illustrated. This second form of tab 20 includes the means 40 for rendering the remaining tabs 20 which are not front-side-free detachable from the tab retaining device D of the rack R to remain with the bag 11 when the bag 11 is removed from the pack 10 and the rack R. In this form of tab 20, the means for rendering at least the front two wall layers 13, 15 of each bag 11 front-side-free is in the form of a cut extending upwardly from the tab mounting aperture 21 to the top of the tab 20 (as shown in FIGS. 9, 10 and 13). The means 40 for rendering the remaining tabs 20 (which are not front-side-free) detachable from the tab retaining device D of the rack R preferably is in the form of a V-shaped cut-out in the top portion of the tab 20 and a nick extending from the V-shaped cut-out toward the mounting aperture 21 (as shown in FIGS. 11 and 14 particularly) for propagating a tear from the tab mounting aperture 21 to the top of the tab 20 for detaching the tab 20 from the tab retaining device D of the rack R while retaining sufficient strength in the portion of the tab 20 above the tab mounting aperture 21 to prevent premature tearing of the tab.

Referring now to FIGS. 16–19, a second embodiment of a pack 10 of easy opening plastic bags 11 of the T-shirt type is illustrated. In addition to the common structural features indicated by the same reference numerals described above with respect to the first embodiment of the invention of FIGS. 1–15, this second embodiment of a pack 10 of easy opening T-shirt plastic bags 11 further include handle layers 30 extending upwardly from the top portions of each of the eight respective front and rear walls 13, 14 and gusseted side walls 15. These handle layers 30 are in superimposed positions in the pack 10 and have seals 31 securing the tops of each juxtaposed group of four handle layers 30 to define a pair of laterally-spaced upwardly-extending handles positioned on each side of the bag 11 (as shown in FIGS. 17) in the opened position of the bag 11. The detachable tabs 20 of each of the T-shirt plastic bags 11 of this second embodiment extend integrally upwardly from each of the superimposed handle layers 30 (see FIGS. 16, 18 and 19). These detachable tabs 20 are also in superimposed position and also include apertures 21 for mounting each of the tabs 20 of the bags 11 on the tab retaining device D of the rack R. At least the front four detachable mounting tabs 20 include means therein for rendering one of the handles front-side-free for aiding in opening of the bag.

Figure 16:
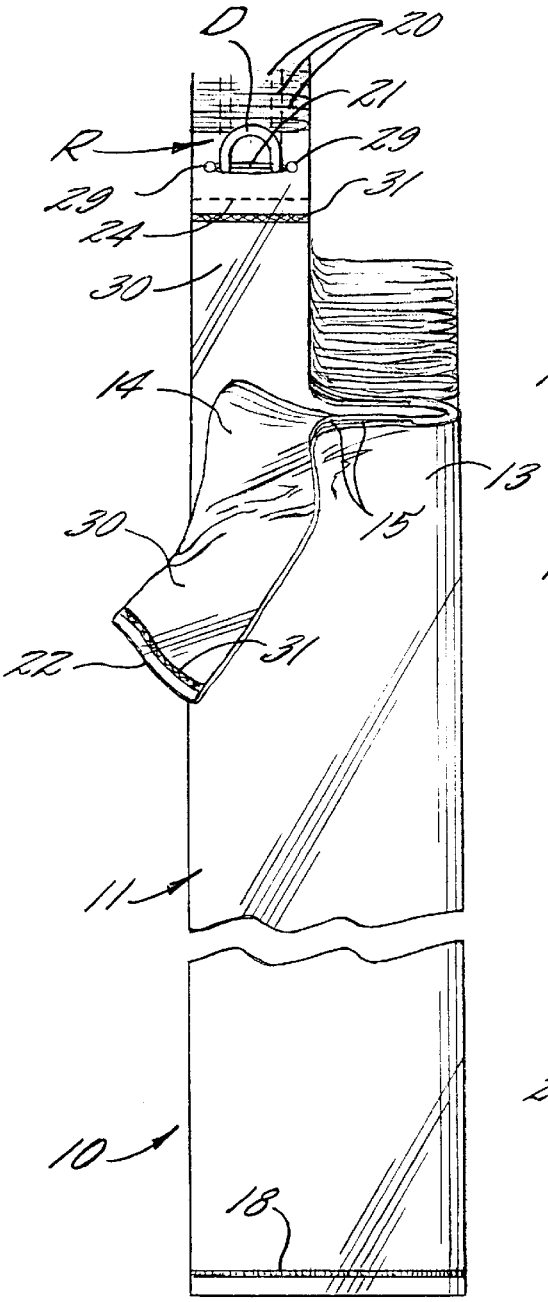
FIG. 16 is a perspective view, broken away, of a second embodiment of a pack of easy opening bags of the T-shirt type constructed in accordance with this invention and mounted on a rack and having a first form of tabs of the type which are constructed for being detached from the bag and remain with the rack as the bags are serially removed from the pack and from the rack.

In a first form of these tabs 20 (as illustrated in FIGS. 16 and 17), the means for rendering one of the handles of each of the bags front-side-free comprises a cut extending across the entire dimension of the four tabs 20 making up the front handle 30 to render such handle front-side-free (as shown in FIG. 16). The remaining tabs 20 extending upwardly from the other handle 30 include the means 24 for rendering such remaining tabs 20 detachable from the bag 11 to remain on the rack R after removal of the bag 11 from the pack 10. This means 24 in this first form of tab 20 of the second embodiment may be in the form of a line of perforations extending across the dimensions of the remaining tabs 20 (as shown in FIG. 16) to adapt these tabs 20 to be easily torn to detach the tabs 20 from the bag 11 when serially removing the bag 1I1 from the pack 10. Thus, the first form of tab 20 (illustrated in FIGS. 16 and 17) remain on the tab retaining device D of the rack R as each T-shirt bag 11 is removed from its pack 10 and from the rack R.

Figure 19:
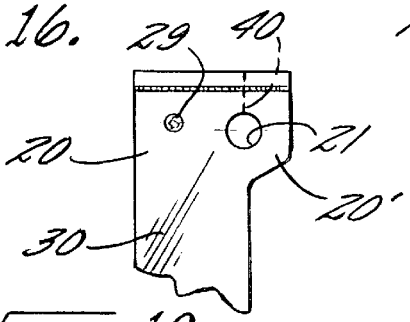
FIG. 19 is a partial front elevational view of one of the tabs of the bag of FIG. 18 and taken along the line 19—19 of FIG. 18 and illustrating one of the tabs which is not front-side-free but which has means therein for detaching of the tab from the rack to remain with the bag as the bag is removed from the pack and from the rack.

A second form of tab 20 for the T-shirt type plastic bags 11 is illustrated in FIGS. 18 and 19. In this second form of tabs 20, the means 22 for rendering one of the handles 30 of each bag 11 front-side-free is in the form of a cut extending from the tab mounting aperture 21 to the top of the tab 20 (as shown in FIG. 18). This second form of tab 20 for the T-shirt type plastic bags 11 includes means 40 in the remaining tabs 20 which are not front-side-free for rendering such remaining tabs 20 detachable from the tab retaining device D of the rack R to remain with the bag 11 when the bag 11 is removed from the pack 10. This means 40 comprises a line of perforations extending from the tab mounting aperture 21 to the top of the tab 20 to adapt the tabs 20 to be easily torn to detach the tabs 20 from the tab retaining device D on the rack R when serially removing the bags 11 from the pack 10 and from the rack R.

In either form of tabs 20 described above for the T-shirt plastic bags of this second embodiment (illustrated in FIGS. 16–18), the tabs 20 extending upwardly from each of the superimposed handle layers 30 may have wider dimension than the handle layers 30 to extend inwardly of the bags 11 in the open position thereof to define an inwardly extending portion 20' (as shown in FIGS. 18 and 19). In this alternative shape of tab 20, the tab mounting aperture 21 is positioned generally in the inwardly extending portion 20' for aiding in balancing of the bag pack 10 when mounted on the rack R. Although this alternative shape is only illustrated in FIGS. 18 and 19, it may also be utilized with the form of the tabs 20 of the T-shirt bags 11 illustrated in FIGS. 16 and 17.

The easy opening plastic bags 11 of both the handleless type and the T-shirt type described above preferably include at least one welded area and usually two welded areas 29 which weld the tabs 20 together to maintain the bags 11 in the pack 10. In the form of tabs 20 which are detachable from the rack R to remain with the bags 11 when the bags 11 are removed from the pack 10 and from the rack R, these welds 29 are frangible for being broken apart as the bags 11 are removed from the pack 10 (as shown in FIGS. 12 and 15). In the other form of tabs 20 which are detachable from the bags 11 and remain on the rack R when the bags 11 are removed from the pack 10 and from the rack R, the welds 29 are of a more permanent type to hold the tabs together as the bags are removed (as shown in FIGS. 5–7).

Also, a frangible bond 28 (as shown in FIG. 7) may be provided between each of the bags 11 in the pack 10 of both the handleless type and the T-shirt type described above to aid in serially opening of the bags 11. As one bag is 11 is completely removed from the pack 10, the frangible bond 28 will pull the leading front-side-free bag layers of the next bag 11 forwardly before the frangible bond 28 is broken which begins the opening process of the next bag.

The handleless type and the T-shirt type plastic bags 11 may be constructed of any suitable plastic material. It has been found that LDPE or HMW-HDPE in gages of from 0.50 to 0.35 mil may be preferred, as discussed above. The star seal 18 may be formed in any suitable manner including a heat seal. The welded areas 29 in the tabs 20 may be formed in any suitable manner including a heat weld formed by hot pin staking, particularly for those tabs which remain together and are detached from the bags 11 and remain on the rack R as the bags 11 are removed from the rack R and the handle 10. The welded areas 29 may be in the form of pressure bonded welded areas for the tabs 20 which are constructed to be detachable from the rack R and remain with the bags 11 as the bags 11 are removed from the pack 10 and from the rack R. The frangible bonds 28 between the bags 11 to aid in serially opening of the bags 11 may be formed in any suitable manner including the use of a suitable frangible adhesive. It should be clearly understood that the bag materials and the types of seals, bonds and welds utilized with the bags 11 of the packs 10 of this invention may vary within the scope of this invention.

As may be seen from the above description of two preferred embodiments with two forms of bag mounting tabs, a pack 10 of easy opening plastic bags 11 of the star seal type which are particularly suited for use in packaging grocery produce and the like and which are adapted for being suspended in desired lengths from a rack R for being serially opened and removed from the rack R for easy packaging of produce has been provided which overcomes the problems with prior plastic bags of this type in failing to provide the easy opening features desired by the customers. These bags 11 of this invention are easily accessible by a user and are easily opened, as described above.

This invention has been described in considerable detail with reference to these preferred embodiments. However, it will be apparent that variations and modifications can be made within the spirit and scope of the invention as described in the foregoing detailed specification and as defined in the following claims.

What is claimed is:

1. A pack of easy opening plastic bags particularly suited for use in packaging grocery produce and adapted for being suspended in desired lengths from a rack for being serially opened and removed from said rack, each of said bags comprising:

integrally formed front and rear walls and gusseted side walls extending inwardly toward each other to terminate in close proximity to each other, said walls having top portions defining an open mouth, and said front and rear walls and said gusseted side walls being further folded over onto each other along a longitudinal axis of said bag to define eight superimposed wall layers in said bag;

a seal of the star seal type securing the bottoms of said eight superimposed wall layers together to close the bottom of said bag; and a tab extending upwardly from each of said eight wall layers at said top portion and being in superimposed positions and each including an aperture adapted for mounting said tabs on a tab retaining device of the rack, at least said front two tabs of said eight superimposed tabs having means therein for rendering at least said front two wall layers of each said bag front-side-free for aiding in easy opening of said bags.

2. A pack of easy opening handleless type plastic bags particularly suited for use in packaging grocery produce and adapted for being suspended in desired lengths from a rack for being serially opened and removed from said rack, each of said bags comprising:

integrally formed front and rear walls and gusseted side walls extending inwardly toward each other to terminate in close proximity to each other, said walls having top portions defining an open mouth, and said front and rear walls and said gusseted side walls being further folded over onto each other along a longitudinal axis of said bag to define eight superimposed wall layers in said bag;

a seal of the star seal type securing the bottoms of said eight superimposed wall layers together to close the bottom of said bag; and a tab extending integrally upwardly from each of said eight wall layers at said top portion and being in superimposed positions and each including an aperture adapted for mounting said tabs on a tab retaining device of the rack, at least the front two said tabs of said eight superimposed tabs having means rendering at least said front two wall layers of each said bag front-side-free for aiding in easy opening of said bags, and the remaining said tabs including means for rendering said remaining tabs detachable from the remaining said bag wall layers to remain on the rack after removal of said bag from said pack.

3. A pack of easy opening handleless type plastic bags, as set forth in claim 2, in which said means rendering said front two wall layers of each said bag front-side-free comprises a cut extending across the entire dimension of said two tabs.

4. A pack of easy opening handleless type plastic bags, as set forth in claim 2 or 3, in which said means for rendering said remaining tabs detachable from the remaining said bag wall layers comprises a slit extending across a portion of the dimension of said tab to define residual wall portions adapted to be easily torn to detach said tabs from said bag when serially removing said bags from said pack.

5. A pack of easy opening handleless type plastic bags, as set forth in claim 4, in which each of said detachable tabs includes a neck portion which is narrower than the remaining portion of said tab and which connects said tab to said wall layer, and in which said slits are located in said neck portion.

6. A pack of easy opening handleless type plastic bags particularly suited for use in packaging grocery produce and adapted for being suspended in desired lengths from a rack for being serially opened and removed from said rack, each of said bags comprising:

integrally formed front and rear walls and gusseted side walls extending inwardly toward each other to terminate in close proximity to each other, said walls having top portions defining an open mouth, and said front and rear walls and said gusseted side walls being further folded over onto each other along a longitudinal axis of said bag to define eight superimposed wall layers in said bag;

a seal of the star seal type securing the bottoms of said eight superimposed wall layers together to close the bottom of said bag; and a tab extending integrally upwardly from each of said eight wall layers at said top portion and being in superimposed positions and each including an aperture adapted for mounting said tabs on a tab retaining device of the rack, at least the front two of said tabs of said eight superimposed tabs having means rendering at least said front two wall layers of each said bag front-side-free for aiding in easy opening of said bags, and the remaining said tabs including means for rendering said remaining tabs detachable from the tab retaining device of the rack to remain with said bag when said bag is removed from said pack.

7. A pack of easy opening handleless type plastic bags, as set forth in claim 6, in which said means for rendering said front two wall layers of each said bag front-side-free comprises a cut extending upwardly from said tab mounting aperture to the top of said tab.

8. A pack of easy opening handleless type plastic bags, as set forth in claim 6 or 7, in which said means for rendering said remaining tabs detachable from the tab retaining device of the rack comprises means for propagating a tear from said tab mounting aperture to the top of said tab for detaching said tab from the tab retaining device of the rack while retaining sufficient strength in the portion of said tab above said tab mounting aperture to prevent premature tearing of said tab.

9. A pack of easy opening handleless type plastic bags, as set forth in claim 8, in which said means for propagating a tear from said tab mounting aperture to the top of said tab comprises a V-shaped cut-out in the top of said tab over said tab mounting aperture and a nick formed in said tab and extending from said V-shaped cut-out toward said tab mounting aperture.

10. A pack of easy opening T-shirt type plastic bags particularly suited for use in packaging grocery produce and adapted for being suspended in desired lengths from a rack for being serially opened and removed from said rack, each of said bags comprising:

integrally formed front and rear walls and gusseted side walls extending inwardly toward each other to terminate in close proximity to each other, said walls having top portions defining an open mouth;

handle layers extending upwardly from said top portions of said walls and being in superimposed positions on each side of said open mouth to form two groups of four handle layers and having seals securing tops of each group of superimposed of handle layers together to define laterally-spaced upwardly-extending handles on each side of said bag in the open position thereof;

said front and rear walls, said gusseted side walls and said handles being further folded over on to each other along a longitudinal axis of said bag to define eight superimposed wall layers and handle layers in said bag;

a seal of the star seal type securing the bottoms of said eight superimposed wall layers together to close the bottom of said bag; and a tab extending upwardly from each of said eight superimposed wall layers and integrally from the tops of said handle layers and being in superimposed positions and including an aperture adapted for mounting each of said tabs on a tab retaining device of the rack, at least said front four tabs of said eight superimposed tabs having means therein for rendering one of said handles of each said bag front-side-free for aiding in easy opening of said bags, and the remaining said tabs including means for rendering said remaining tabs detachable from the remaining said handle layers to remain on the rack after removal of the bag from said pack.

11. A pack of easy opening T-shirt type plastic bags, as set forth in claim 10, in which said means for rendering one of said handles of each of said bags front-side-free comprises a cut extending across the entire dimension of said four tabs extending upwardly from said handle layers.

12. A pack of each opening T-shirt type plastic bags, as set forth in claim 10 or 11, in which said means for rendering said remaining tabs detachable from the remaining said handle layers to remain on the rack after removal of the bag from said pack comprises a line of perforations extending across the dimension of said tab to adapt said tabs to be easily torn to detach said tabs from said bag when serially removing said bags from said pack.

13. A pack of easy opening T-shirt type plastic bags particularly suited for use in packaging grocery produce and adapted for being suspended in desired lengths from a rack for being serially opened and removed from said rack, each of said bags comprising:

integrally formed front and rear walls and gusseted side walls extending inwardly toward each other to terminate in close proximity to each other, said walls having top portions defining an open mouth;

handle layers extending upwardly from said top portions of said walls and being in superimposed positions on each side of said open mouth to form two groups of four handle layers and having seals securing tops of each group of superimposed of handle layers together to define laterally-spaced upwardly-extending handles on each side of said bag in the open position thereof;

said front and rear walls, said gusseted side walls and said handles being further folded over onto each other along a longitudinal axis of said bag to define eight superimposed wall layers and handle layers in said bag;

a seal of the star seal type securing the bottoms of said eight superimposed wall layers together to close the bottom of said bag; and a tab extending upwardly from each of said eight superimposed wall layers and integrally from the tops of said handle layers and being in superimposed positions and including an aperture adapted for mounting each of said tabs on a tab retaining device of the rack, at least said front four tabs of said eight superimposed tabs having means therein for rendering one of said handles of each said bag front-side-free for aiding in easy opening of said bags, and the remaining said tabs including means for rendering said remaining tabs detachable from the tab retaining device of the rack to remain with said bag when said bag is removed from said pack.

14. A pack of easy opening T-shirt type plastic bags, as set forth in claim 13, in which said means for rendering one of said handles of each said bag front-side-free comprises a cut extending from said tab mounting aperture to the top of said tab.

15. A pack of easy opening T-shirt type plastic bags, as set forth in claim 13 or 14, in which said means for rendering said remaining tabs detachable from the tab retaining device of the rack when said bag is removed from said pack comprises a line of perforations extending from said tab mounting aperture to the top of said tab to adapt said tabs to be easily torn to detach said tabs from the tab retaining device on the rack when serially removing said bags from said rack.

16. A pack of easy opening T-shirt plastic bags, as set forth in claim 10 or 13, in which said tabs extending upwardly from each of said eight superimposed handle layers have a wider dimension than said handle layers to extend inwardly of said bag in the open position thereof to define an inwardly extending portion, and in which said tab mounting aperture is positioned in said inwardly extending portion of said tab for aiding in balancing said bag pack when mounted on the rack.

17. A pack of easy opening plastic bags, as set forth in claim 1, 2, 6, 10 or 13, in which each of said tabs includes at least one welded area welding said tabs together for maintaining said bags in said pack.

18. A pack of easy opening plastic bags, as set forth in claim 1, 2, 6, 10 or 13, further including a frangible bond between each of said bags in said pack to aid in serially opening of said bags as said bags are serially removed from said pack.

* * * * *

UNITED STATES PATENT AND TRADEMARK OFFICE
CERTIFICATE OF CORRECTION

PATENT NO. : 5,941,393

DATED : August 24, 1999

INVENTOR(S) : Wilfong, Jr.

It is certified that error appears in the above-identified patent and that said Letters Patent is hereby corrected as shown below:

On the title page, [56] References Cited, the following was omitted:

--FOREIGN PATENT DOCUMENTS 0 541028 5/1993 European Patent Office--

Column 10, line 47, after "superimposed" cancel "of".

Column 11, line 8, "each" should read --easy--; line 29, after "superimposed" cancel "of".

Signed and Sealed this

Twenty-ninth Day of February, 2000

*Attest:*

Q. TODD DICKINSON

*Attesting Officer*

*Commissioner of Patents and Trademarks*